US011352226B2

(12) United States Patent
Nishimura et al.

(10) Patent No.: US 11,352,226 B2
(45) Date of Patent: Jun. 7, 2022

(54) SHEET FEED DEVICE

(71) Applicant: BROTHER KOGYO KABUSHIKI KAISHA, Nagoya (JP)

(72) Inventors: Yoichiro Nishimura, Kitakyushu (JP); Asami Hashimoto, Okazaki (JP); Gakuro Kanazawa, Toyokawa (JP); Tetsuo Asada, Kuwana (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 161 days.

(21) Appl. No.: 16/749,028

(22) Filed: Jan. 22, 2020

(65) Prior Publication Data

US 2020/0307929 A1 Oct. 1, 2020

(30) Foreign Application Priority Data

Mar. 29, 2019 (JP) ..... JP2019-065968

(51) Int. Cl.
*B65H 3/06* (2006.01)
*B65H 1/04* (2006.01)

(52) U.S. Cl.
CPC ..... *B65H 3/0684* (2013.01); *B65H 1/04* (2013.01); *B65H 2404/521* (2013.01); *B65H 2404/531* (2013.01); *B65H 2404/54* (2013.01); *B65H 2405/1118* (2013.01); *B65H 2405/11161* (2013.01); *B65H 2405/141* (2013.01); *B65H 2405/142* (2013.01)

(58) Field of Classification Search
CPC ..... B65H 1/00; B65H 1/04; B65H 3/0684; B65H 2404/50; B65H 2404/52; B65H 2404/521; B65H 2404/531; B65H 2404/5311; B65H 2404/54; B65H 2405/111; B65H 2405/1111; B65H 2405/1112; B65H 2405/1116; B65H 2405/11161; B65H 2405/1118; B65H 2405/141; B65H 2405/142
See application file for complete search history.

(56) References Cited

U.S. PATENT DOCUMENTS

2011/0085840 A1* 4/2011 Shiohara ..... B65H 3/56 400/578
2013/0256977 A1* 10/2013 Aoki ..... B65H 3/56 271/117
2015/0084263 A1* 3/2015 Kanzawa ..... B65H 3/0676 271/3.2

FOREIGN PATENT DOCUMENTS

JP 2006-225075 A 8/2006
JP 2013-199353 A 10/2013

* cited by examiner

*Primary Examiner* — Prasad V Gokhale
(74) *Attorney, Agent, or Firm* — Scully, Scott, Murphy & Presser, P.C.

(57) ABSTRACT

A sheet feed device includes a housing, a tray, a feed roller, an arm, a pad, and a protruding portion. The housing has a sheet conveyance path. The tray includes a bottom plate having a sheet support surface that supports a sheet. The sheet conveyance path extends upward from the sheet support surface. The feed roller rotates about a rotational axis and feeds the sheet supported on the sheet support surface in a first direction. The arm rotatably supports the feed roller. The arm swingably moves about an axis parallel to the rotational axis of the feed roller. The pad is disposed on the bottom plate. The pad has a higher friction coefficient than a friction coefficient of the sheet support surface. The protruding portion protrudes upward from the sheet support surface at a position shifted from the pad in a second direction opposite from the first direction.

14 Claims, 6 Drawing Sheets

SHEET FEED DEVICE

CROSS REFERENCE TO RELATED APPLICATIONS

This application claims priority from Japanese Patent Application No. 2019-065968 filed Mar. 29, 2019. The entire content of the priority application is incorporated herein by reference.

TECHNICAL FIELD

This disclosure relates to a sheet feed device.

BACKGROUND

In a sheet feed device, a plurality of sheets are stacked on a support surface on a tray. The sheets on the support surface are guided by a guide portion to a conveyance path while being fed out by a feed roller in a feed direction. The sheet feed device includes a first pad, a second pad and a switching mechanism. The second pad is arranged so as to be adjacent to the first pad on the support surface and has a smaller friction coefficient than that of the first pad. The switching mechanism causes the first pad to face the feed roller when there are two or more sheets on the support surface and causes the second pad to face the feed roller when there is one sheet on the support surface. With this configuration, the sheet feed device suppresses the occurrence of misfeed. The misfeed is a phenomenon that, for example, the last sheet on the support surface is not fed out by the feed rollers.

SUMMARY

According to one aspect, this specification discloses a sheet feed device. The sheet feed device includes a housing, a tray, a feed roller, an arm, a pad, and a protruding portion. The housing has a sheet conveyance path. The tray includes a bottom plate having a sheet support surface configured to support a sheet. The sheet conveyance path extends upward from the sheet support surface. The feed roller is configured to rotate about a rotational axis and to feed the sheet supported on the sheet support surface in a first direction. The arm rotatably supports the feed roller. The arm is configured to swingably move about an axis parallel to the rotational axis of the feed roller. The pad is disposed on the bottom plate. The pad has a higher friction coefficient than a friction coefficient of the sheet support surface. The protruding portion protrudes upward from the sheet support surface at a position shifted from the pad in a second direction opposite from the first direction.

BRIEF DESCRIPTION OF THE DRAWINGS

Embodiments in accordance with this disclosure will be described in detail with reference to the following figures wherein:

FIGS. 5A and 5B are schematic diagrams showing the configuration of rotational members 23B that is a first modification of the protruding portions 23, wherein FIG. 5A shows the rotational members 23B and its periphery along a cross-section parallel to a left-right direction X and FIG. 5B shows the rotational members 23B and its periphery along a cross-section parallel to a front-rear direction Y along a line VB-VB in FIG. 5A; and FIGS. 6A and 6B are schematic diagrams showing the configuration of ribs 23C that is a second modification of the protruding portions 23, wherein FIG. 6A is a top view of the ribs 23C and its periphery and FIG. 6B is a cross-sectional view when a cross-section along a line VIB-VIB in FIG. 6A is viewed from the front side.

DETAILED DESCRIPTION

When a sheet such as thick paper is fed out from the tray and bends while being conveyed along the conveyance path, the sheet comes into sliding contact with a portion upstream of the pad on the tray in the feed direction. When this happens, the tray is subject to greater load from the sheet at the upstream portion in sliding contact with the sheet. As a result, the amount of friction generated at the upstream portion increases. The bent sheet also makes sliding contact with a guide surface or other components along the conveyance path, resulting in an increase in friction generated between the bent sheet conveyed along the conveyance path and the guide surface on the conveyance path. This sliding contact may cause an increase in resistance at the leading end of the sheet while the sheet is conveyed to a position partway along the conveyance path, so that the sheet cannot be fed further downstream. In particular, when conveying a stiff glossy paper having a high surface friction coefficient, the above-mentioned sliding contact may cause resistance to increase such that the glossy sheet cannot be fed out from the tray. In other words, misfeed occurs.

In view of the foregoing, an aspect of an object of this disclosure is to provide a sheet feed device configured to suppress misfeed of a sheet.

Some aspects of this disclosure will be described while referring to the attached drawings. In the following description, an upper-lower direction Z is defined in a state where an MFP (multifunction peripheral) 10 is placed in an orientation in which the MFP 10 is intended to be used (the state of FIG. 1), a front-rear direction Y is defined by defining a surface formed with an opening 13 as a front surface 14A, and a left-right direction X is defined in a state where the MFP 10 is viewed from the front. The upper-lower direction Z, the front-rear direction Y, and the left-right direction X are perpendicular to each other.

[Overall Structure of MFP 10]

Figure 1:
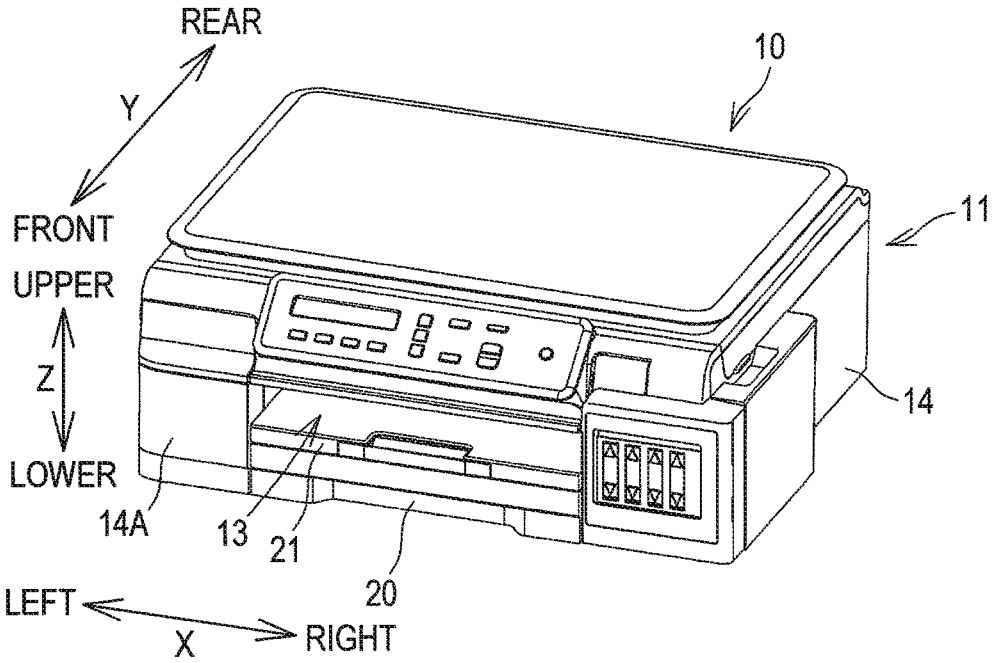
FIG. 1 is a perspective view of an MFP 10.

As shown in FIG. 1, the MFP 10 is substantially formed as a rectangular parallelepiped. The MFP 10 includes a printer unit 11 and records an image on a sheet 12 (see FIG. 2). The sheet 12 is thick paper which is stiff and has large flexural rigidity. More specifically, the sheet 12 is stiff glossy paper with a high surface friction coefficient. The MFP 10 may include a facsimile function and a scanning function in addition to a printing function.

[Configuration of Printer Unit 11]

As shown in FIG. 1, the printer unit 11 is an example of a sheet feed device and includes a housing 14. The opening 13 is formed in the front surface 14A of the housing 14. This opening 13 is located at a substantially central portion of the front surface 14A in both the upper-lower direction Z and the left-right direction X.

Figure 2:
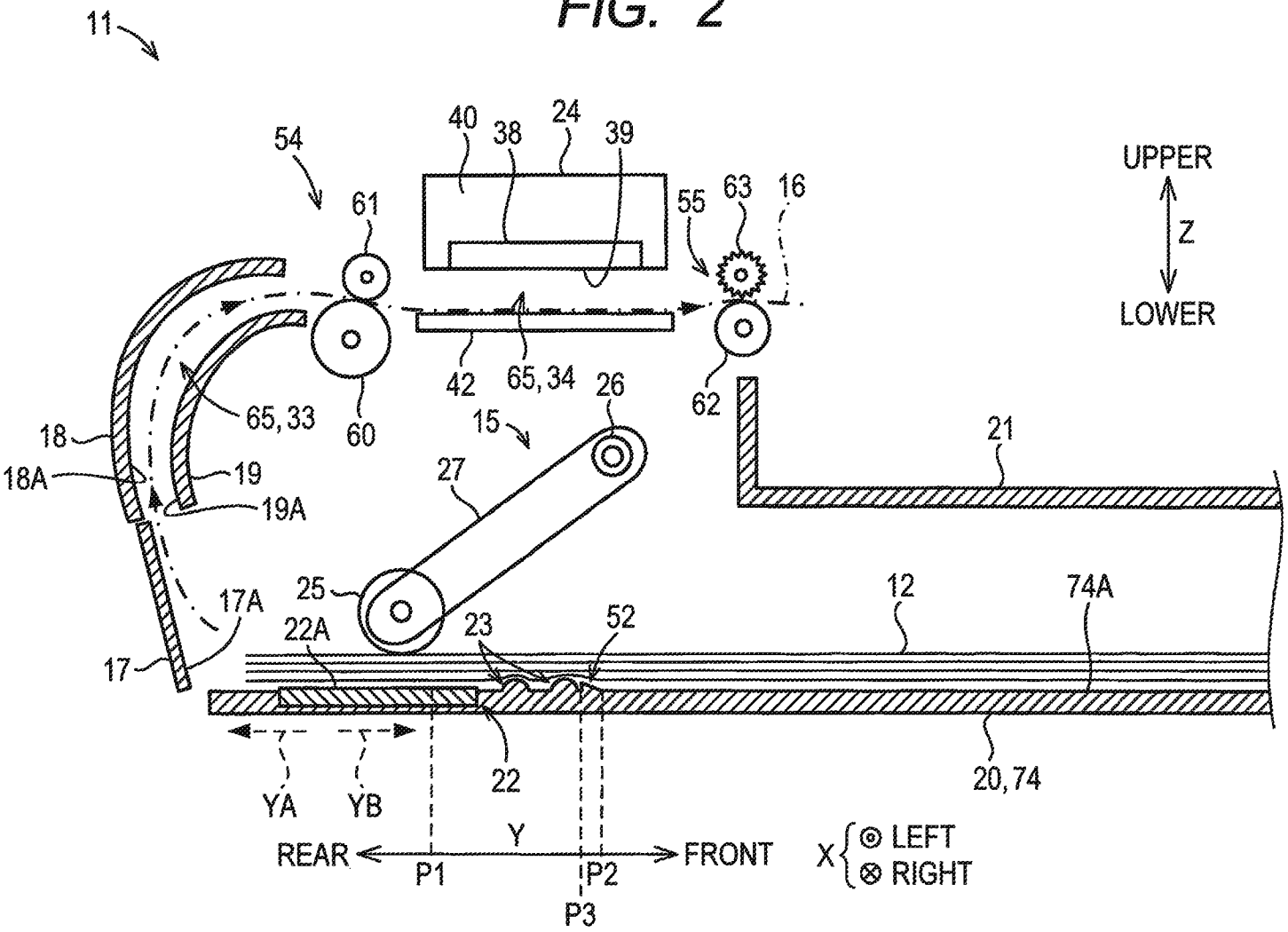
FIG. 2 is a schematic diagram showing the internal structure of a printer unit 11.

As shown in FIG. 2, a feed tray 20, a discharge tray 21, a feed unit 15, a conveyance path 65, a pad 22, four protruding portions 23 (see FIG. 3), two slanted portions 52, a conveyance roller unit 54, a recording unit 24, a discharge roller unit 55, and a platen 42 are disposed in the housing 14 (see FIG. 1) of the printer unit 11.

[Feed Tray 20]

The feed tray 20 can be inserted into and removed from the housing 14 (see FIG. 1) through the opening 13. When inserted, the feed tray 20 moves rearward in the front-rear direction Y through the opening 13 and mounted at a particular mount position. When retracted, the feed tray 20 moves forward from the mount position in the front-rear direction Y.

Figure 3:
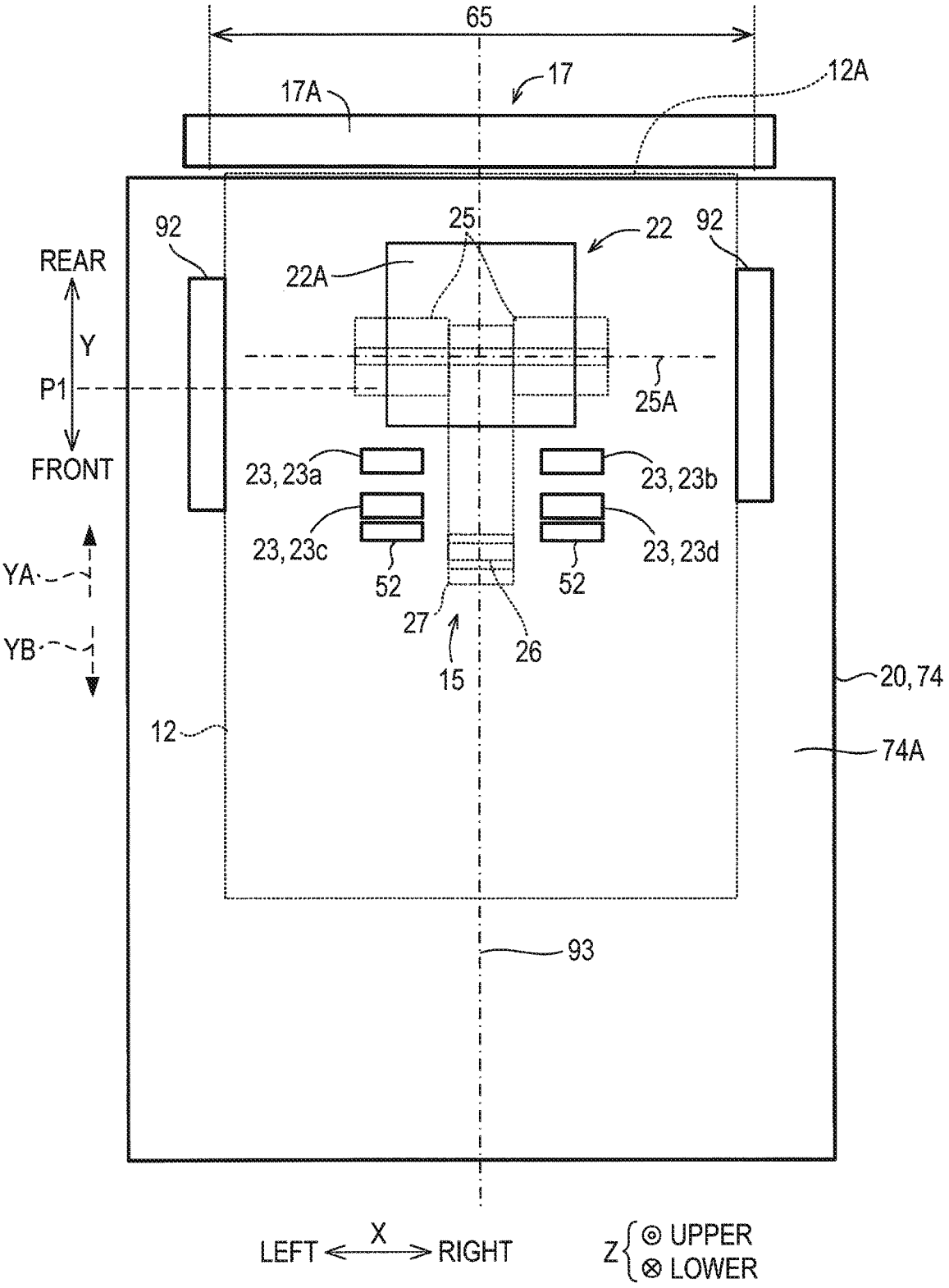
FIG. 3 is a schematic diagram showing the arrangement of a feed roller 25, a feed tray 20, and protruding portions 23.

As shown in FIG. 3, the feed tray 20 includes a bottom plate 74 and a pair of side guides 92. The bottom plate 74 has a support surface 74A that faces upward. The support surface 74A supports a plurality of the sheets 12. The pair of side guides 92 are disposed to face each other in the left-right direction X and are supported by the bottom plate 74 such that the pair of side guides 92 moves in the left-right direction X. When one of the pair of side guides 92 moves to either the right or left, the other of the pair of side guides 92 moves in conjunction with that side guide 92 in the opposite direction. The pair of side guides 92 contacts end portions of the sheet 12 in the left-right direction X placed on the support surface 74A so as to position the sheet 12 such that the center of the sheet 12 in the left-right direction X sits along a reference line 93 on the support surface 74A. The reference line 93 is a virtual line that extends forward from the center of the conveyance path 65 in the left-right direction X. The top sheet 12 on the support surface 74A is fed out in a first direction YA by the feed unit 15. The first direction YA is a rearward direction in the front-rear direction Y.

[Discharge Tray 21]

As shown in FIG. 1, the discharge tray 21 is disposed above the feed tray 20 in the housing 14. The discharge tray 21 supports the sheet 12 discharged by the discharge roller unit 55 and on which an image has been recorded.

[Conveyance Path 65]

The conveyance path 65 includes a curved section 33 and a straight section 34. The curved section 33 is defined by a lower guide portion 17, an external guide portion 18, and an internal guide portion 19 and extends so as to curve upward in a second direction YB from the vicinity of a rear end of the support surface 74A. In other words, the conveyance path 65 has a U-turn shape. The second direction YB is a direction opposite the first direction YA. The lower guide portion 17 includes a guide surface 17A that extends diagonally upward toward the rear from the rear end of the feed tray 20 in the housing 14 (see FIG. 1). The external guide portion 18 includes an external guide surface 18A that curves upward in the second direction YB from an upper end of the lower guide portion 17. The internal guide portion 19 is disposed with a gap relative to the external guide portion 18 in the second direction YB and includes an internal guide surface 19A that faces the external guide surface 18A.

The straight section 34 extends in a substantially straight line from a downstream end of the curved section 33 in the second direction YB. The straight section 34 is defined by the conveyance roller unit 54, the recording unit 24, the platen 42 and the discharge roller unit 55. The straight section 34 is continuous with the downstream end of the curved section 33 and extends in a substantially straight line until reaching the discharge roller unit 55.

On the conveyance path 65, a leading end portion of the sheet 12 fed out from the feed tray 20 contacts the lower guide portion 17. The leading end portion of the sheet 12 comes into sliding contact with the guide surface 17A to be guided upward. Then, the leading end portion of the sheet 12 is fed between the external guide surface 18A and the internal guide surface 19A by the guide surface 17A. Thereafter, the sheet 12 is guided through the curved section 33 while making sliding contact with the external guide surface 18A and fed to the straight section 34. While the sheet 12 is conveyed through the straight section 34, the recording unit 24 records an image on the sheet 12. After an image is recorded on the sheet 12, the sheet 12 is discharged to the discharge tray 21 by the discharge roller unit 55.

[Feed Unit 15]

As shown in FIG. 2, the feed unit 15 includes a feed roller 25, a shaft 26 and an arm 27. A peripheral surface of the feed roller 25 contacts the pad 22 from above when there is no sheet 12 on the support surface 74A. Here, the position at which the feed roller 25 contacts the support surface 74A is referred to as a "contact position P1". The contact position P1 is preferably as close as possible to the lower guide portion 17. The shaft 26 is disposed at a position that is diagonally farther forward and upward than the contact position P1 in the housing 14. The shaft 26 supports a front end of the arm 27. The shaft 26 extends in parallel to the left-right direction X, and the arm 27 is configured to rotatably (swingably) move about the axis of the shaft 26. A rear end of the arm 27 supports the feed roller 25. The axis of the feed roller 25 is parallel to the axis of the shaft 26. The feed roller 25 is configured to rotate while being supported by the arm 27.

In the feed unit 15, the feed roller 25 contacts the top (uppermost) sheet 12 on the support surface 74A. In this state, rotation is transmitted from a driving force transmission unit (not shown) that includes a motor and gears, to thereby rotate the feed roller 25. When the feed roller 25 rotates, the top sheet 12 is fed out in the first direction YA.

[Pad 22]

The pad 22 has a thin and flat shape, for example. The friction coefficient of an upper surface 22A of the pad 22 is larger than the friction coefficient of the support surface 74A. The pad 22 is made from, for example, cork. As shown in FIG. 3, the pad 22 is disposed on the bottom plate 74 of the feed tray 20 such that the upper surface 22A of the pad 22 overlaps a virtual line 25A when viewed from above. The virtual line 25A is a straight line that extends along the rotational axis of the feed roller 25. A part of the pad 22 is located at the same position as the rotational axis of the feed roller 25 with respect to the front-rear direction Y. That is, the pad 22 is located at such a position that the feed roller 25 can contact the pad 22 when there is no sheet 12 on the feed tray 20. As seen from the upper-lower direction Z, the upper surface 22A has a rectangular shape symmetric with reference to the reference line 93. As shown in FIG. 2, the upper surface 22A is slightly taller than the support surface 74A in the upper-lower direction Z. The pad 22 contacts the bottom sheet 12 placed on the support surface 74A. A large amount of friction occurs between the upper surface 22A of the pad 22 and the bottom sheet 12. This amount of friction is larger than the amount of friction generated between the bottom sheet 12 and the support surface 74A. In addition, an amount of friction larger than the amount of friction generated between the stacked sheets 12 occurs between the upper surface 22A of the pad 22 and the bottom sheet 12. When the top sheet 12 placed on the support surface 74A is fed out in the first direction YA by the feed roller 25, the bottom sheet 12 is unlikely to move in the first direction YA due to the friction that occurs between the bottom sheet 12 and the pad 22. As a result, when a few sheets 12 are stacked on the support surface 74A, a state in which multiple sheets 12 are simultaneously fed out by the feed roller 25 (in other words, "multiple feed") is prevented.

[Protruding Portion 23]

As shown in FIG. 2, the protruding portions 23 are integrally molded with the feed tray 20 and are fixed to the support surface 74A of the feed tray 20.

The protruding portions 23 protrude upward from the support surface 74A. Each protruding portion 23 has an external shape that is elongated in the left-right direction X (see FIG. 3). The surface of each protruding portion 23 is curved (rounded) and bulges upward when viewed in the left-right direction X. Upper ends of the protruding portions 23 are located at slightly higher positions than the upper surface 22A of the pad 22. The friction coefficient of the surface of each protruding portion 23 is smaller than the friction coefficient of the support surface 74A. The friction coefficient of the surface of each protruding portion 23 is reduced by, for example, performing mirror finishing on the surfaces of the protruding portions 23 such that the surfaces are smoother than the surface of the support surface 74A.

As shown in FIG. 3, each protruding portion 23 faces the sheet 12 placed on the support surface 74A from below the sheet 12. The protruding portions 23 are separated from the feed roller 25 located at the contact position P1 in the second direction YB. That is, the protruding portions 23 are located at positions shifted in the second direction YB from a position at which the feed roller 25 contacts the support surface 74A or the pad 22. Therefore, the protruding portions 23 do not contact the feed roller 25. The protruding portions 23 are located at positions away (shifted) from the front end of the pad 22 in the second direction YB. Increasing the distance between the protruding portions 23 and the contact position P1 makes it easier for the bottom sheet 12 to contact the pad 22, even when a stiff sheet 12 (having large flexural rigidity) is placed on the support surface 74A. As a result, the occurrence of multiple feed can be reduced.

As shown in FIG. 3, the protruding portions 23 and the pad 22 are arranged along the second direction YB. Here, the term "arranged along the second direction YB" refers to a case where the protruding portions 23 and the pad 22 at least partly overlap when viewed from the second direction YB.

As shown in FIG. 3, the four protruding portions 23 are arranged symmetric with respect to the reference line 93. Two protruding portions 23*a* and 23*c* are arranged at the left side of the reference line 93 in the front-rear direction Y. Two protruding portions 23*b* and 23*d* are arranged at the right side of the reference line 93 in the front-rear direction Y. With this arrangement, the two protruding portions 23*a* and 23*b* are disposed at different positions in the direction of the rotational axis of the feed roller 25. The same goes for the two protruding portions 23*c* and 23*d*. The two protruding portions 23*a* and 23*c* are arranged at different positions in the front-rear direction Y. The same goes for the two protruding portions 23*b* and 23*d*.

[Slanted Portion 52]

Two slanted portions 52 are formed on the support surface 74A. These two slanted portions 52 are located at the front side of the two protruding portions 23*c* and 23*d*, respectively. As shown in FIG. 2, each slanted portion 52 has a flat surface that is slanted upward from a first position P2 on the support surface 74A toward a second position P3. The first position P2 is located at a farther forward position than the protruding portions 23 in the front-rear direction Y and at the same position as the support surface 74A in the upper-lower direction Z. The second position P3 is located between the protruding portions 23 and the first position P2 in the front-rear direction Y and between the support surface 74A and the upper end of the protruding portions 23 in the upper-lower direction Z. The slanted portions 52 guide the rear end of the sheet (the leading end when the sheet is conveyed) placed on the feed tray 20 upward from the lower ends of the protruding portions 23.

[Conveyance Roller Unit 54 and Discharge Roller Unit 55]

As shown in FIG. 2, the conveyance roller unit 54 is located in the straight section 34. The conveyance roller unit 54 includes a conveyance roller 60 and a pinch roller 61 that face each other in the upper-lower direction Z. Rotation is transmitted from a motor (not shown) to the conveyance roller 60 to rotate the conveyance roller 60. The pinch roller 61 rotates along with the rotation of the conveyance roller 60. The conveyance roller 60 and the pinch roller 61 nippingly hold the sheet 12 conveyed through the curved section 33 and feed the sheet 12 out in the second direction YB (in other words, to the straight section 34).

The discharge roller unit 55 is located at a farther forward position than the conveyance roller unit 54 in the straight section 34. The discharge roller unit 55 includes a discharge roller 62 and a spur 63 that face each other in the upper-lower direction Z. Rotation is transmitted from a motor (not shown) to the discharge roller 62 to rotate the discharge roller 62. The spur 63 rotates along with the rotation of the discharge roller 62. The discharge roller unit 55 nippingly holds the sheet 12 conveyed through the straight section 34 and discharges the sheet 12 to the discharge tray 21.

[Recording Unit 24]

The recording unit 24 is located above the straight section 34 between the conveyance roller unit 54 and the discharge roller unit 55. The platen 42 faces the recording unit 24 below the straight section 34. The platen 42 supports the sheet 12 that is conveyed through the straight section 34. The recording unit 24 records an image on the sheet 12 supported by the platen 42 by using an inkjet printing method. The recording unit 24 is not limited to using an inkjet printing method and may record an image on the sheet 12 by using an electro-photographic method.

[Operation of Feeding Thick Paper 12 from Feed Tray 20]

Next, an operation of feeding the last sheet of thick paper 12 from the feed tray 20 in the first direction YA is described. The thick paper 12 is an example of a relatively stiff (having large flexural rigidity) sheet and has a printing surface coated with a layer that does not readily absorb ink. This thick paper 12 is used for high-quality printing, such as printing photographs. In the feed tray 20, the printing surface of the thick paper 12 faces downward.

Figure 4:
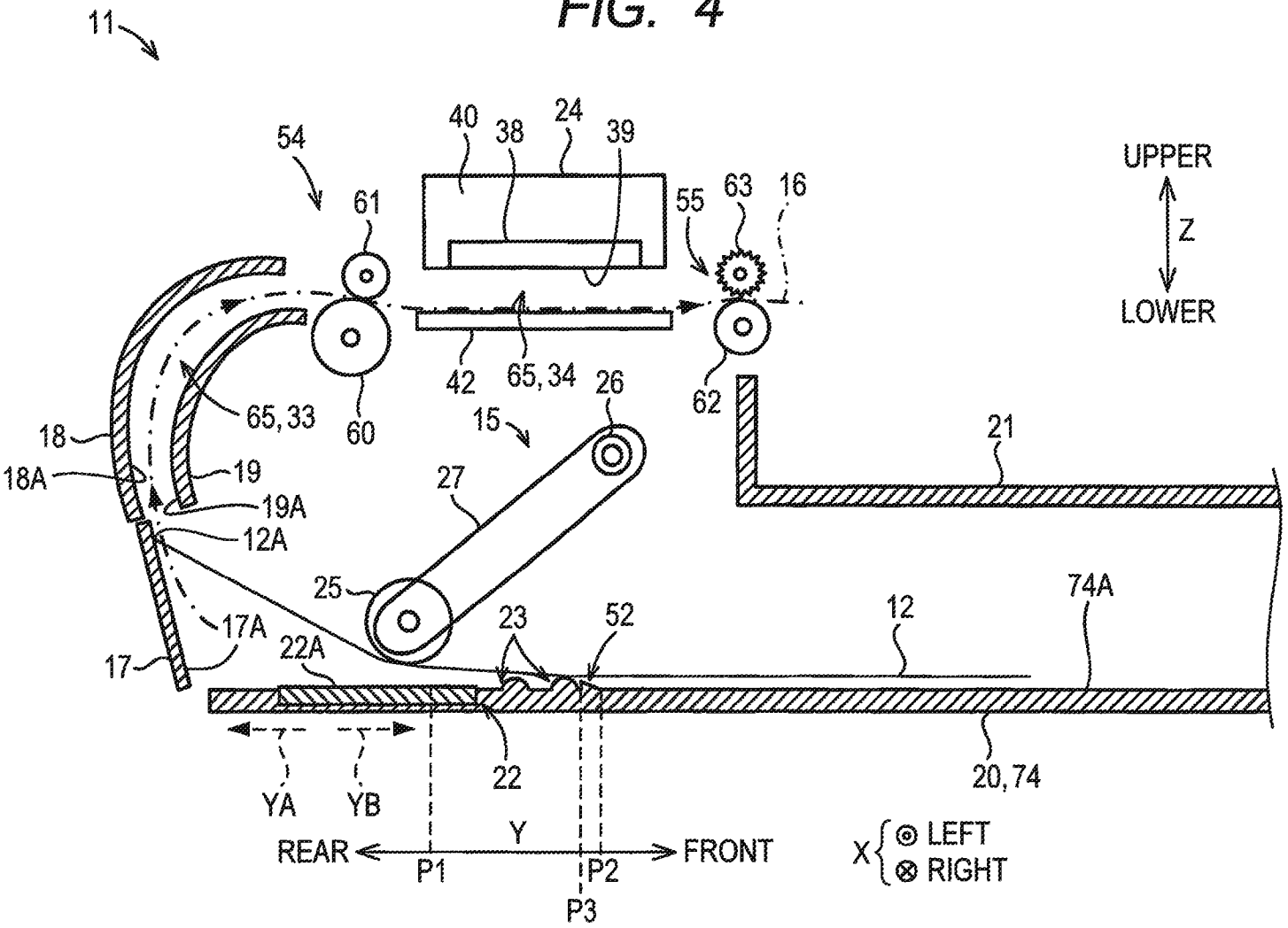
FIG. 4 is a schematic diagram showing the posture of a sheet 12 that is being conveyed.

When the feed roller 25, which is located close to the support surface 74A in the upper-lower direction Z, rotates, the thick paper 12 on the support surface 74A is fed out in the first direction YA. When the thick paper 12 is fed out in the first direction YA, the rear end 12A (the leading end) of the thick paper 12 is guided by the guide surface 17A so as to be directed upward toward the curved section 33. At this time, the rear end 12A of the thick paper 12 is located at a higher position than the support surface 74A in the upper-lower direction Z. In this state, as shown in FIG. 4, the stiffness of the thick paper 12 causes the thick paper 12 to not bend along the guide surface 17A and therefore separate from the guide surface 17A. The posture of the thick paper 12 cause the feed roller 25 to be brought up to a position in the upper-lower direction Z that is higher than the vicinity of the support surface 74A at which the thick paper 12 is started to be fed. The feed roller 25 then rotates while being held up by the thick paper 12 to further feed out the thick paper 12 in the first direction YA.

Effects of Embodiment

At a position on the support surface 74A of the feed tray 20 shifted from the contact position P1 in the second direction YB (that is, a portion farther upstream in the first direction YA than the contact position P1 on the support surface 74A), the thick paper 12 places a large amount of load on the feed tray 20. With the above configuration, at the upstream portion, the thick paper 12 is supported by the protruding portions 23. Therefore, the amount of friction generated between the thick paper 12 and the protruding portions 23 when the thick paper 12 contacts the protruding portions 23 is smaller than the amount of friction generated between the thick paper 12 and the support surface 74A when the thick paper 12 contacts the support surface 74A. That is, thanks to the protruding portions 23, the contact load between the thick paper 12 and the support surface 74A can be reduced. As a result, this suppresses an occurrence of misfeed that the feed roller 25 idly rotates (slips) relative to the thick paper 12 and the thick paper 12 is not fed out.

The protruding portions 23 are fixed to the feed tray 20. More specifically, the protruding portions 23 are formed integrally with the feed tray 20. Therefore, the protruding portions 23 and the feed tray 20 can be manufactured at low cost.

Because the friction coefficient of the protruding portions 23 is lower than that of the support surface 74A, the amount of friction generated between the thick paper 12 and the protruding portions 23 can be reduced when the thick paper 12 is fed.

Because the upper ends of the protruding portions 23 are located above the upper surface 22A, the sheet 12 fed out from the support surface 74A is less likely to contact the pad 22.

Because the protruding portions 23 do not contact the feed roller 25, the occurrence of misfeed can be reduced when only a few sheets 12 are placed on the support surface 74A.

The slanted portions 52 guide the rear end of the sheet 12 placed on the feed tray 20 to a position higher than the lower ends of the protruding portions 23. Therefore, the rear end of the sheet 12 on the feed tray 20 is less likely to be caught on the protruding portions 23. As a result, the sheet 12 can be more easily set on the feed tray 20.

A user sometimes places the sheet 12 (see FIG. 2) on the support surface 74A from the front side of the feed tray 20 in a state where the feed tray 20 is removed. Because the protruding portions 23 are located a position shifted in the second direction YB from the pad 22, the rear end (the leading end) of the sheet 12 is guided upward by the protruding portions 23 and the rear end (the leading end) of the sheet 12 is less likely to contact the pad 22. As a result, the sheet 12 can be more easily set on the feed tray 20.

The two protruding portions 23*a* and 23*b* are disposed at different positions in the direction of the rotational axis of the feed roller 25. Therefore, even if the last sheet 12 on the support surface 74A is curved in this direction, the last sheet 12 is likely to contact the protruding portion 23*a* or 23*b*. Here, as the protruding portions 23 are closer to the pad 22, the positional relationship between the upper ends of the protruding portions 23 and the upper surface 22A of the pad 22 is more reliably maintained even if the feed tray 20 has warp in a molding process, for example. Thus, the last sheet 12 is more likely to contact the protruding portions 23.

When the last sheet 12 placed on the support surface 74A is fed out to the conveyance path 65, the position in the front-rear direction Y at which the sheet 12 bends on the support surface 74A differs depending on the stiffness of the sheet 12 and the curved shape of the conveyance path 65. By arranging the two protruding portions 23 in the front-rear direction Y, a variety of different sheets 12 are more likely to contact the protruding portions 23.

Modification

Next, modifications of the embodiment will be described. In the following descriptions, like parts and components are designated by the same reference numerals to avoid duplicating description.

Figure 5A:
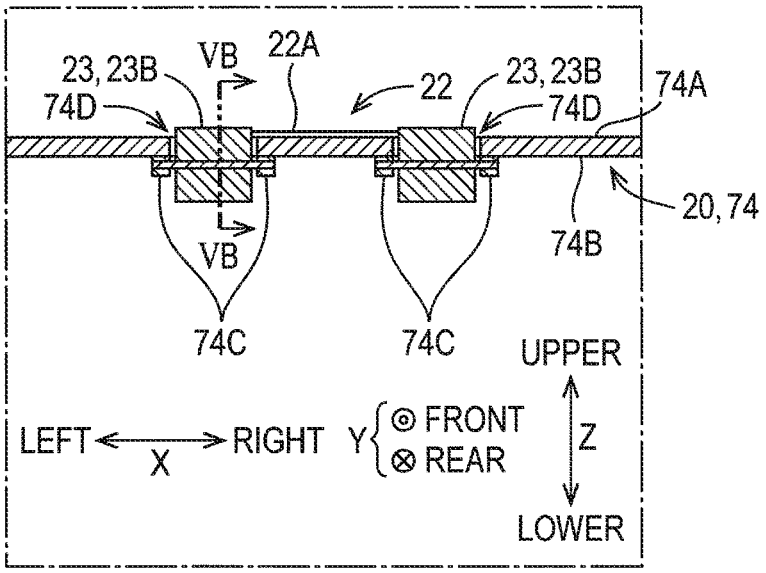
Figure 5B:
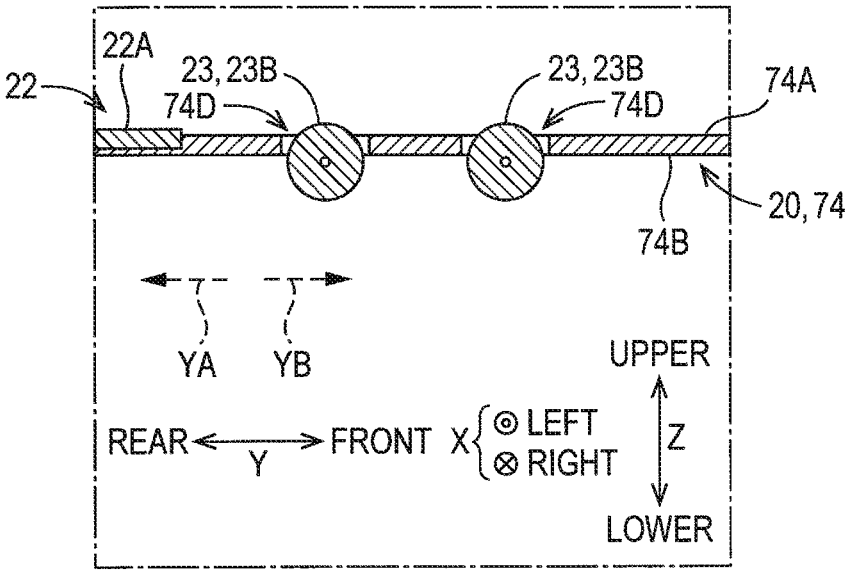

In a modification, the feed tray 20 is provided with rotational members 23B shown in FIGS. 5A and 5B in place of the protruding portions 23. The bottom plate 74 includes a lower surface 74B located opposite from the support surface 74A. Four through holes 74D are formed in the bottom plate 74. The through holes 74D penetrate the bottom plate 74 in the upper-lower direction Z. The four through holes 74D are disposed at the same positions as the protruding portions 23.

Each through hole 74D has a rectangular shape that is elongated in the left-right direction X when viewed in the upper-lower direction Z. As shown in FIG. 5A, two mount portions 74C are provided around the periphery of each through hole 74D on the lower surface 74B. The mount portions 74C are arranged along the left-right direction X and rotationally support the axes of the rotational members 23B.

As shown in FIG. 5B, each rotational member 23B has a columnar shape. The rotational members 23B supported by the mount portions 74C protrude through the through holes 74D farther upward than the support surface 74A. An upper end of each rotational member 23B is located at a slightly higher position than the upper surface 22A of the pad 22.

By providing the feed tray 20 with the rotational members 23B, the occurrence of misfeed of the thick paper 12 can be reduced, in a similar manner to the above-described embodiment.

Figure 6A:
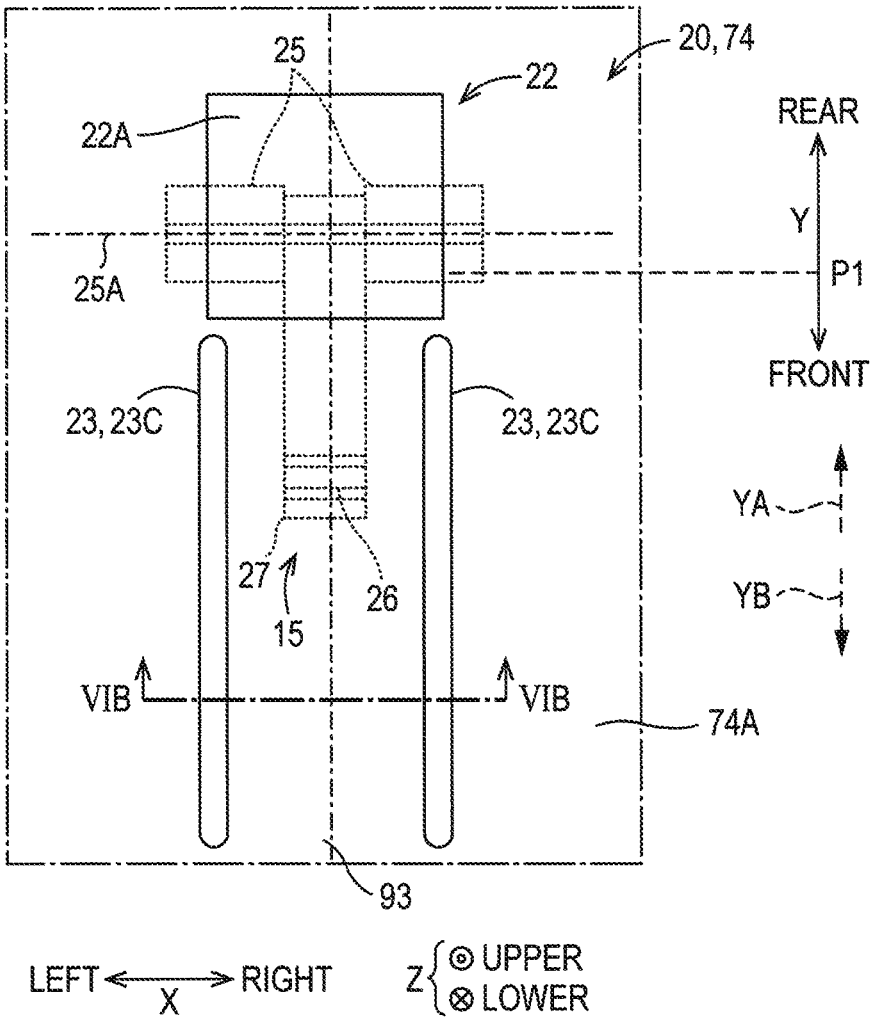
Figure 6B:
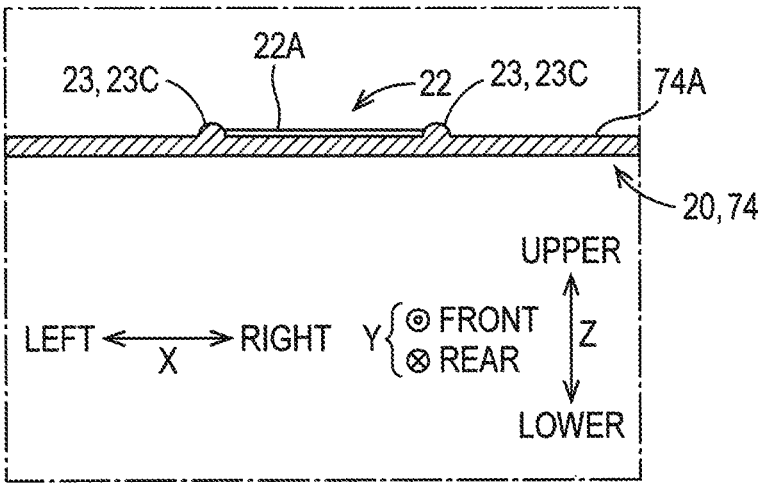

As shown in FIGS. 6A and 6B, the feed tray 20 on the support surface 74A may be provided with two ribs 23C in place of the protruding portions 23. The ribs 23C are elongated in the front-rear direction Y. As shown in FIGS. 6A and 6B, each rib 23C has a size along the left-right direction X sufficiently smaller than the size along the front-rear direction Y. The size (length) of each rib 23C along the front-rear direction Y are set in consideration of the stiffness of each sheet supported by the feed tray 20 and other factors. As shown in FIG. 6B, the two ribs 23C protrude upward from the support surface 74A. The positions of the two ribs 23C are symmetric with respect to the reference line 93. By providing the feed tray 20 with the ribs 23C, the occurrence of misfeed of the thick paper 12 can be reduced, in a similar manner to the above-described embodiment.

Other Modification

While the disclosure has been described in detail with reference to the above aspects thereof, it would be apparent to those skilled in the art that various changes and modifications may be made therein without departing from the scope of the claims.

For example, the shape of the conveyance path 65 is not limited to a U-turn shape and may be an S-shape path (a path in which a sheet makes a U-turn twice) when viewed in the left-right direction X.

FIG. 3 illustrates a configuration in which the feed roller 25 contacts the pad 22. However, the present disclosure is not limited to this configuration and the feed roller 25 may be disposed away from the pad 22 in the left-right direction X and contact the support surface 74A. In this case, the virtual line 25A that extends in the left-right direction X from the rotational axis of the feed roller 25 overlaps the upper surface 22A.

The printer unit 11 may include a first pad, a second pad, and a switching mechanism in place of the above-described pad 22 (see FIG. 2). The second pad is disposed on the support surface 74A so as to be adjacent to the first pad in the left-right direction X and has a smaller friction coefficient than the first pad. The switching mechanism causes the first pad to face the feed roller 25 when there are two or more sheets 12 on the support surface 74A and causes the second pad to face the feed roller 25 when there is one sheet 12 on the support surface 74A. In this case, the protruding portions 23 protrude upward from the support surface 74A at positions shifted in the second direction YB from the first pad or the second pad that faces the feed roller 25.

The friction coefficient of each protruding portion 23 may be the same as the friction coefficient of the support surface 74A.

What is claimed is:

1. A sheet feed device comprising:

a housing having a sheet conveyance path;

a tray including a bottom plate having a sheet support surface configured to support a sheet, the sheet conveyance path extending upward from the sheet support surface;

a feed roller configured to rotate about a rotational axis and to feed the sheet supported on the sheet support surface in a first direction;

an arm rotatably supporting the feed roller, the arm being configured to swingably move about an axis parallel to the rotational axis of the feed roller;

a pad disposed on the bottom plate, the pad having a higher friction coefficient than a friction coefficient of the sheet support surface; and a protruding portion protruding upward from the sheet support surface at a position shifted from the pad in a second direction opposite from the first direction, wherein the protruding portion is fixed to the tray, the protruding portion having a smaller friction coefficient than the friction coefficient of the sheet support surface.

2. The sheet feed device according to claim 1, wherein a part of the pad is located at a same position as the rotational axis with respect to the first direction.

3. The sheet feed device according to claim 1, wherein the protruding portion is integrally formed with the tray.

4. The sheet feed device according to claim 1, wherein the protruding portion is a rotational member that is supported at the tray so as to rotate about an axis parallel to the rotational axis of the feed roller.

5. The sheet feed device according to claim 1, wherein an upper end of the protruding portion is located at a higher position than an upper surface of the pad.

6. The sheet feed device according to claim 1, wherein the protruding portion is disposed at a position where the protruding portion does not contact the feed roller.

7. The sheet feed device according to claim 1, wherein the sheet conveyance path extends upward from the sheet support surface while being curved and then extends in the second direction; and wherein the sheet feed device further comprises a conveyance roller configured to convey the sheet in the second direction through the sheet conveyance path.

8. The sheet feed device according to claim 1, further comprising a slanted portion having a surface extending upward from a particular position on the sheet support surface toward the protruding portion, the particular position being shifted from the protruding portion in the second direction.

9. The sheet feed device according to claim 1, wherein the protruding portion is provided at a position away from the pad in the second direction.

10. The sheet feed device according to claim 1, wherein the pad and the protruding portion are arranged along the second direction.

11. The sheet feed device according to claim 1, wherein the protruding portion includes a plurality of protruding portions; and wherein the plurality of protruding portions is arranged at different positions in a direction parallel to the rotational axis of the feed roller.

12. The sheet feed device according to claim 1, wherein the protruding portion includes a plurality of protruding portions; and wherein the plurality of protruding portions is arranged at different positions with respect to the first direction.

13. The sheet feed device according to claim 1, wherein the protruding portion includes a plurality of protruding portions; and wherein the plurality of protruding portions is spaced away from each other in a direction parallel to the rotational axis of the feed roller, each of the plurality of protruding portions having an elongated shape that is elongated in the second direction.

14. The sheet feed device according to claim 1, wherein the protruding portion has a surface that is curved and bulges upward when viewed in a direction parallel to the rotational axis of the feed roller.

* * * * *